US008323386B2

(12) United States Patent
Langle et al.

(10) Patent No.: US 8,323,386 B2
(45) Date of Patent: Dec. 4, 2012

(54) APPARATUS AND METHOD FOR ELECTROSTATIC PARTICULATE COLLECTOR

(75) Inventors: Joseph Matthew Langle, Kansas City, MO (US); Buddy Justin Winheim, Kansas City, MO (US); Noah Boydston, Kansas City, MO (US); Steven D. Graham, Overland Park, KS (US); Nancy Zamora Olivares, Kansas City, MO (US); Mark Edward Reynolds, Kansas City, MO (US); Thomas John Breier, Belton, MO (US)

(73) Assignee: Midwest Research Institute, Inc., Kansas City, MO (US)

( * ) Notice: Subject to any disclaimer, the term of this patent is extended or adjusted under 35 U.S.C. 154(b) by 488 days.

(21) Appl. No.: 12/580,887

(22) Filed: Oct. 16, 2009

(65) Prior Publication Data

US 2011/0088556 A1 Apr. 21, 2011

(51) Int. Cl.
*B03C 3/78* (2006.01)

(52) U.S. Cl. ..... 96/44; 55/DIG. 38; 95/75; 96/45; 96/49; 96/50

(58) Field of Classification Search ..... 96/43–45, 96/47, 49, 50; 95/75; 55/DIG. 38
See application file for complete search history.

(56) References Cited

U.S. PATENT DOCUMENTS 2,956,640 A * 10/1960 Tuche et al. ..... 96/49
3,238,702 A 3/1966 DeSeversky
3,507,397 A 4/1970 Robinson
3,568,837 A 3/1971 Laval, Jr.
3,742,681 A 7/1973 deSeversky
3,765,154 A 10/1973 Hardt et al.
3,770,385 A * 11/1973 Grey et al. ..... 422/172
3,785,125 A 1/1974 DeSeversky
3,831,351 A 8/1974 Gibbs et al.
3,874,858 A 4/1975 Klugman et al.
3,918,939 A 11/1975 Hardt (Continued)

FOREIGN PATENT DOCUMENTS

GB 982819 B2 2/1965

(Continued)

OTHER PUBLICATIONS

Huzefa A. Bharmal, "Performance Evaluation of Wet Metal Plate Electrostatic Precipitator" Thesis presented to Russ College of Engineering and Technology Ohio University (2005).

(Continued)

*Primary Examiner* — Richard L Chiesa
(74) *Attorney, Agent, or Firm* — H. Frederick Rusche; Husch Blackwell LLP

(57) ABSTRACT

A compact electrostatic particulate collector for sampling contaminants has a collection chamber defined by a titanium inner surface of a wall. A potential inducer is disposed within the chamber to create a field potential between itself and the wall of the chamber. A blower is disposed to propel air to be sampled through the chamber. At least one rinse channel is disposed to wet the inner surface of the wall of the chamber substantially 100%. The rinse channel is angled to direct a rinse liquid in a spiral direction around the inner surface of the wall. Contaminants in the air being sampled are electro statically biased into the rinse liquid on the wall and rinsed out of the chamber for collection.

42 Claims, 9 Drawing Sheets

U.S. PATENT DOCUMENTS

| | | | | |
|---|---|---|---|---|
| 4,097,358 | A | 6/1978 | Wiseman | |
| 4,160,716 | A | 7/1979 | Wiseman | |
| 4,203,961 | A | 5/1980 | Cowley | |
| 4,502,936 | A | 3/1985 | Hayfield | |
| 4,529,418 | A | 7/1985 | Reif et al. | |
| 5,039,318 | A | 8/1991 | Johansson | |
| 5,137,546 | A | 8/1992 | Steinbacher et al. | |
| 5,626,652 | A * | 5/1997 | Kohl et al. | 96/45 |
| 5,914,454 | A | 6/1999 | Imbaro et al. | |
| 6,053,967 | A | 4/2000 | Heilmann et al. | |
| 6,106,592 | A | 8/2000 | Paranjpe et al. | |
| 6,193,782 | B1 | 2/2001 | Ray | |
| 6,632,267 | B1 * | 10/2003 | Ilmasti | 95/59 |
| 6,669,843 | B2 | 12/2003 | Arnaud | |
| 6,811,690 | B2 | 11/2004 | Arnaud | |
| 7,144,503 | B2 | 12/2006 | Oserod | |
| 7,156,902 | B1 | 1/2007 | Altman | |
| 7,243,560 | B2 | 7/2007 | Coyle et al. | |
| 7,261,008 | B2 | 8/2007 | Saaski et al. | |
| 7,288,139 | B1 | 10/2007 | Showalter | |
| 2001/0020417 | A1 | 9/2001 | Liu et al. | |
| 2004/0083790 | A1 | 5/2004 | Carlson et al. | |
| 2005/0274206 | A1 | 12/2005 | Coyle et al. | |
| 2007/0122320 | A1 | 5/2007 | Pletcher et al. | |
| 2007/0186696 | A1 | 8/2007 | Pletcher et al. | |
| 2009/0314162 | A1 * | 12/2009 | Chen et al. | 96/32 |

FOREIGN PATENT DOCUMENTS

| | | | | |
|---|---|---|---|---|
| GB | 1049470 | B1 | 11/1966 | |
| GB | 1411107 | | 10/1975 | |
| JP | 52-40881 | A * | 3/1977 | 96/45 |
| WO | 0000291 | A1 | 1/2000 | |

OTHER PUBLICATIONS

Bayless et al. "Membrane-based wet electrostatic preciptation" Fuel Processing Technology 85:781-798 (2004).

Mizuno "Electrostatic Preciptation" leeeTrans. on Dielectrics and Elec. Insulation vol. 7(5) 615-624 (2000).

Pasic, "Membrane Based Electrostatic Precipitation" Elec. Precipitators & Membranes, pp. 28-31 (Nov. 2001).

Dec. 6, 2010 Search Report and Written Opinion (PCT/US2010/052166).

* cited by examiner

APPARATUS AND METHOD FOR ELECTROSTATIC PARTICULATE COLLECTOR

CROSS-REFERENCE TO RELATED APPLICATIONS

None.

BACKGROUND OF THE INVENTION

1. Field of the Invention

The invention is in the field of removing particulates from the air, particularly as applied to sampling contaminants.

2. Background

Removing particulate contaminants from the atmosphere may be achieved with several known technologies. One known device is an electrostatic particulate collector. Known electrostatic particulate collectors have traditionally been designed for continuous, high volume use, as for example, as antipollution devices. Prior art devices are disadvantageous in contaminant sampling situations for multiple reasons.

Electrostatic particulate collectors are typically designed with a metallic chamber through which a gas, typically air, is directed for removal of particulate matter such as contaminants. Disposed within the chamber is a current carrying element supplied with sufficient electrical voltage that the potential between itself and the metallic walls of the chamber creates a coronal discharge. The coronal discharge electrostatically charges particulates in the gas within the chamber, and these ionized particles are thereby electrostatically driven to adhere to the walls of the chamber.

Once collected on the chamber walls, the contaminants may be removed. Manual removal of collected contaminants requires frequent shutdown for a replacement and/or cleaning of the chamber walls. To avoid this, it is known to rinse the chamber walls with a liquid in order to collect the removed contaminants and also retard contaminant buildup on the chamber walls. Purified water is often used as a rinse liquid.

Some prior art designs fail to wet all of the chamber wall, allowing disadvantageous contaminant buildup on dry portions of the chamber wall. Prior art devices do not wet the chamber walls quickly, and require significant volumes of liquid in order to achieve adequate wetting of the chamber walls. Prior art designs typically use large cumbersome components, use larger volumes of rinse liquid and demand a high power draw for both rinse liquid distributors and blowers used to propel the atmosphere being treated through the treating chambers.

SUMMARY OF THE INVENTION

The present invention is an electrostatic particulate collector having a novel structure. One aspect of the present invention is to achieve 100% wetting of the inner surface of the chamber wall with a minimum volume of liquid. It is another aspect of the invention to achieve 100% wetting of the inner surface of the chamber wall quickly. In so doing, the structure of the present invention promotes greater efficiency, greater throughput of air to be sampled, greater portability and/or greater automation. Smaller volumes of the required purified water need to be transported or installed with the test unit. Power requirements may be reduced. Speed, water volume and volume of air throughput may be improved because impedance of air flow by the wetting structures is reduced.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
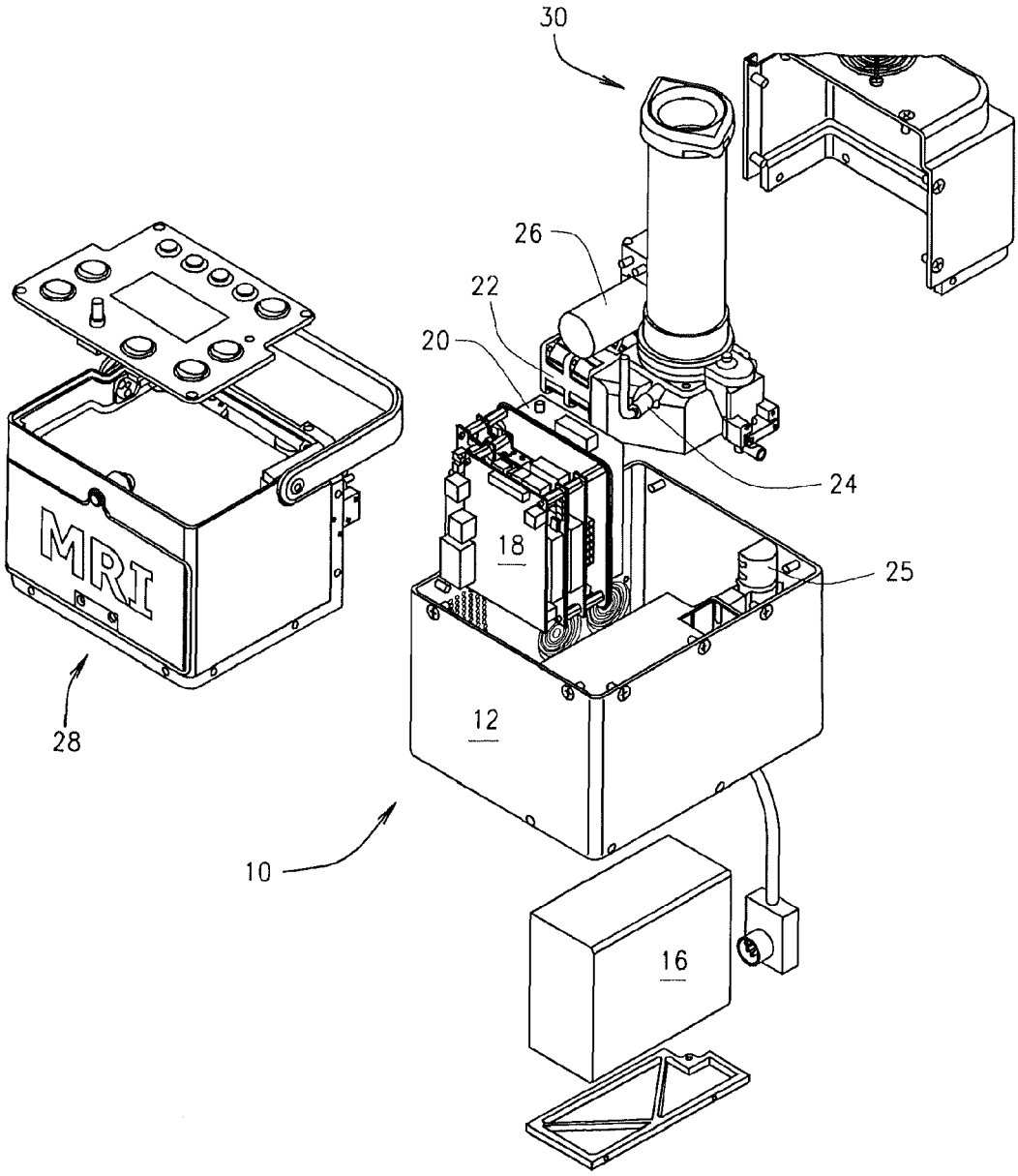
FIG. 1 is an exploded view of the electrostatic particulate collector of the present invention.

Referring now to the drawings in which like reference numbers indicate like elements, FIG. 1 is an exploded overall view of the electrostatic particulate collector of the present invention. Particulate collector 10 is a compact device to promote portability for mobile and rapid response testing of atmospheres such as may have been purposefully contaminated, as for example with a biological agent such as anthrax or other detrimental particulate matter suspended in the air. Accordingly, the compact unit 10 has a housing 12. Alternatively, the unit may also be deployed for automatic testing in response to actuation by a sensor. This provides for installation of the unit for constant monitoring of certain facilities such as government buildings.

Within the housing 12 are the major components of the electrostatic particulate collector including a battery 16, electronic control module 18, high voltage power supply 20, an air handling system having a blower 22, fluid connector 24, pump 26 and the test chamber 30. A fluid reservoir 28 which may be separate, is provided to supply any rinse liquid for wetting the test chamber internally.

Figure 2:
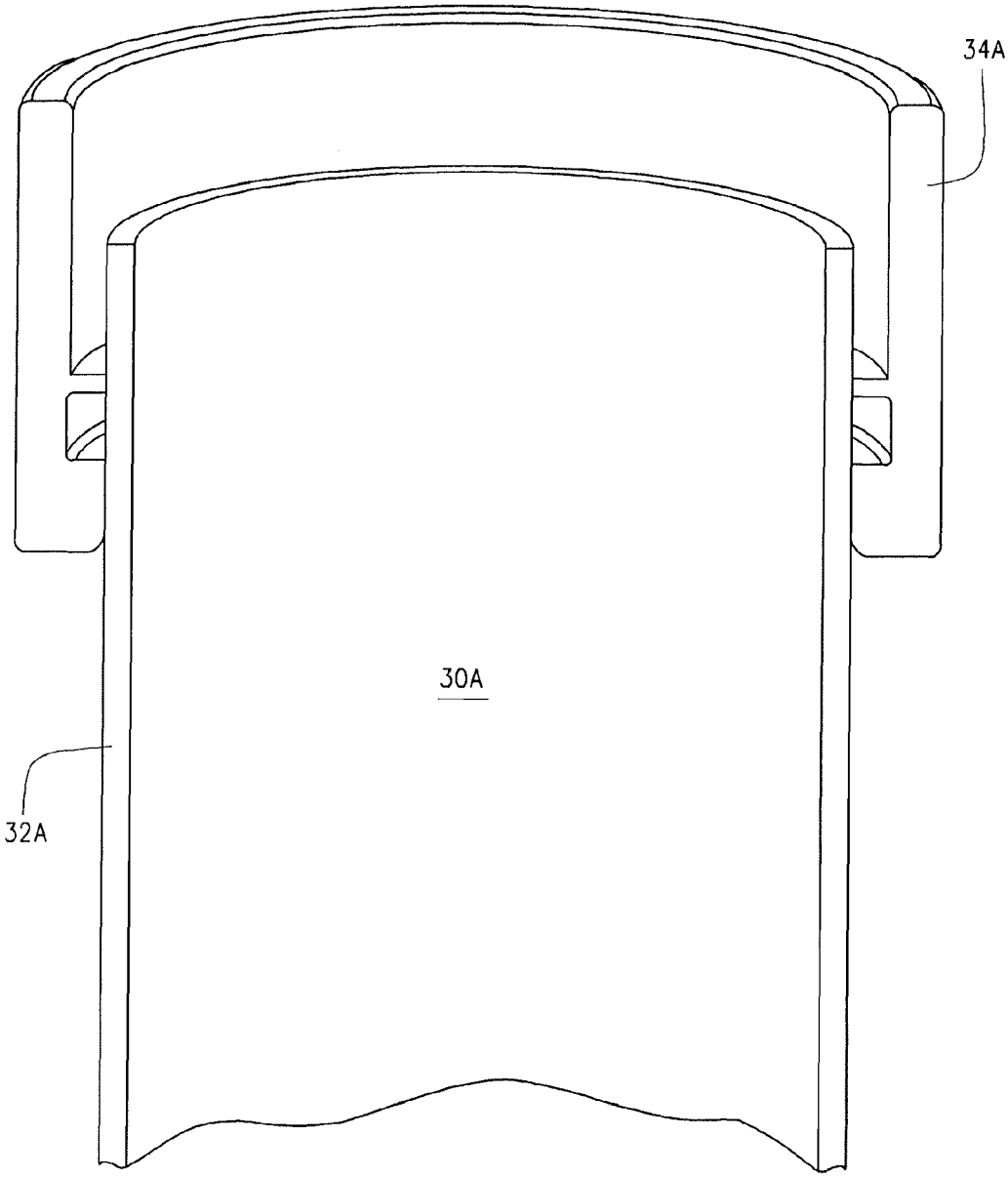
FIG. 2 PRIOR ART
FIG. 2 is a perspective and cutaway view of a prior art weir type fluid distributor and collection tube.

In the depicted embodiments the test chamber is a tube. FIG. 2 depicts a prior art cylindrical test chamber 30A comprised of a metal cylinder 32A and a fluid distributor 34A. The prior art device was a weir type fluid distributor which injects water into the chamber space within the tube 32A by simply over topping the edge of the chamber cylinder 32A. By force of gravity then the provided liquid descended onto the walls of the inner surface of the chamber 32A, thereby wetting it. This design disadvantageously failed to wet 100% of the inner surface of the chamber wall, and left substantial vertical dry portions on the wall between the streams of the fluid provided.

Figure 3:
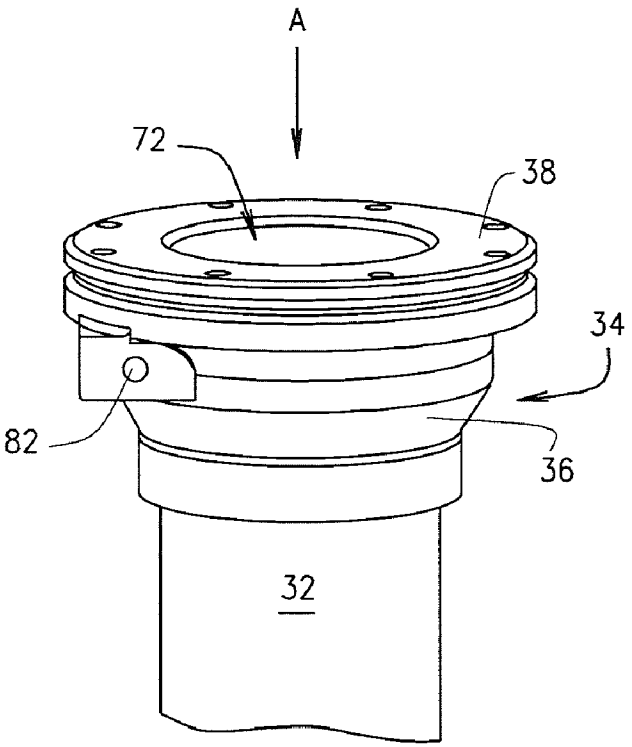
FIG. 3 is a perspective view of a collection tube and fluid distributor.

FIG. 3 depicts the test chamber 30 of the present invention. In the depicted embodiment, the test chamber is a cylindrical tube 32. At a top end a fluid distributor 34 is mounted. In the depicted embodiment the fluid distributor 34 is comprised of an outer shell or receiver 36 and an inner insert 38. The female outer receiver has frustoconical internal surface 40 which is dimensioned to mate with a corresponding frustoconical outer surface 42 of the male fluid distributor insert 38. The components of the fluid distributor 34 may be plastic.

The chamber is a cylindrical tube 32 in the depicted embodiment which may be made of metal. The metal may be steel, titanium, aluminum or otherwise. In the depicted embodiment the tube 32 is comprised of a cylindrical wall 44 having an inner surface 46. The inner surface may be comprised of titanium. Providing a titanium inner surface may be achieved by constructing the entire tube wall 44 of titanium. Alternatively, the tube wall 44 may be aluminum, stainless steel, or other material, with a coating of titanium on its inner surface 46.

Figure 4:
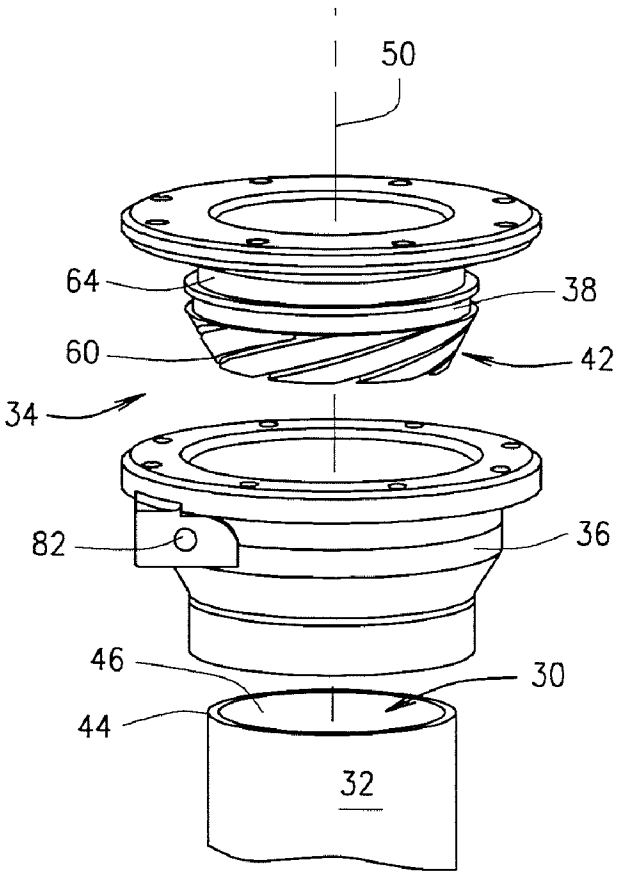
FIG. 4 is an exploded view of a collection tube and fluid distributor.
Figure 8:
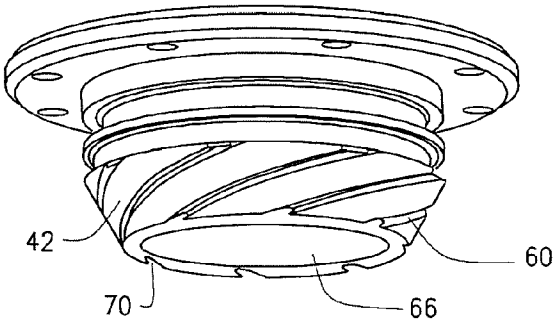
FIG. 8 is a perspective view of the fluid distributor insert.

As is known in the prior art, disposed within the collection chamber is a voltage potential inducer 50 (see FIG. 4). In the depicted embodiment this may be a wire suspended along the axis of the cylinder 32. A voltage is provided to the inducer 50 of sufficient potential, typically on the order of 5,000-30,000 volts, to induce a coronal discharge within the chamber. Hence a potential is established between the inducer 50 and the walls 44 of the chamber 32. Contaminant particles entering into this field are electrostatically biased against the inner surface 46 of the chamber wall.

In operation, air flow is created through the chamber by a blower (22 in FIG. 1, 196 in FIG. 14) blowing contaminated air in the direction A (see FIG. 3).

Figure 5:
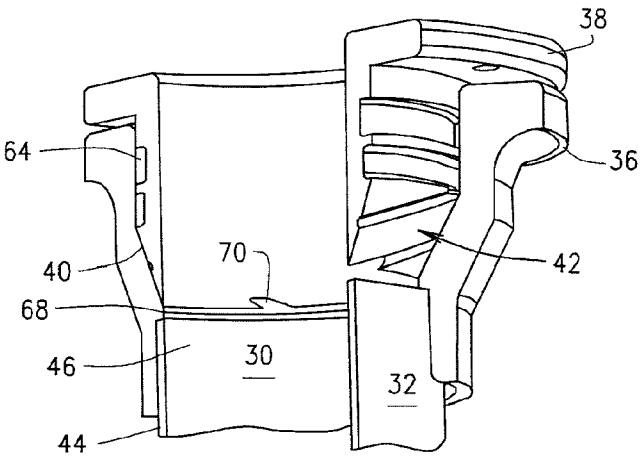
FIG. 5 is a cutaway view of the fluid distributor and collection tube.
Figure 7:
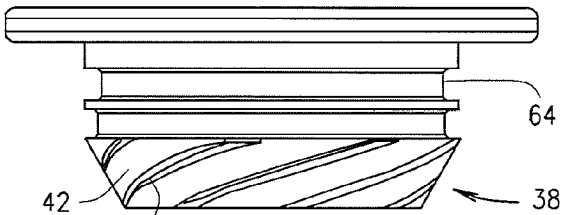
FIG. 7 is a side view of the fluid distributor and collection tube.
Figure 6:
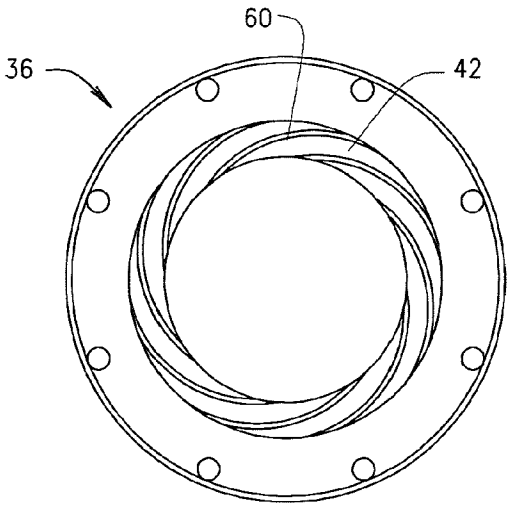
FIG. 6 is a bottom view of the fluid distributor and collection tube.
Figure 11:
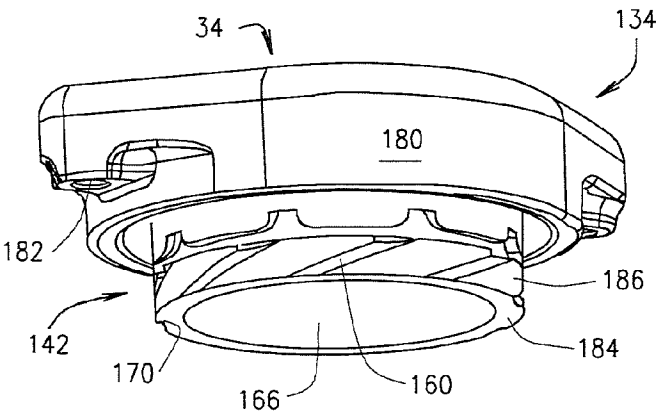
FIG. 11 is a perspective view of an alternative fluid distributor insert.
Figure 9:
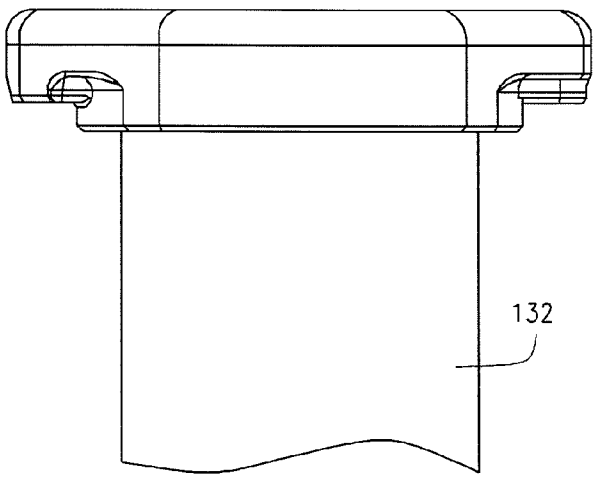
FIG. 9 is a side view of an alternative collection tube and fluid distributor
Figure 10:
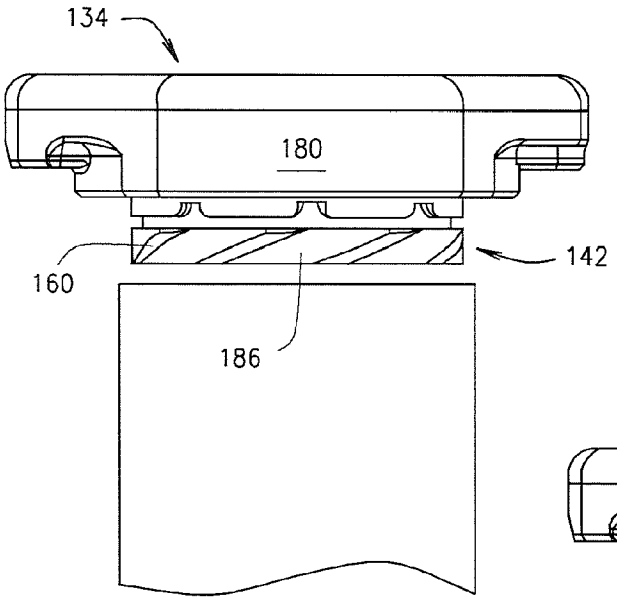
FIG. 10 is an exploded view of an alternative collection tube and fluid distributor in an open position.
Figure 12:
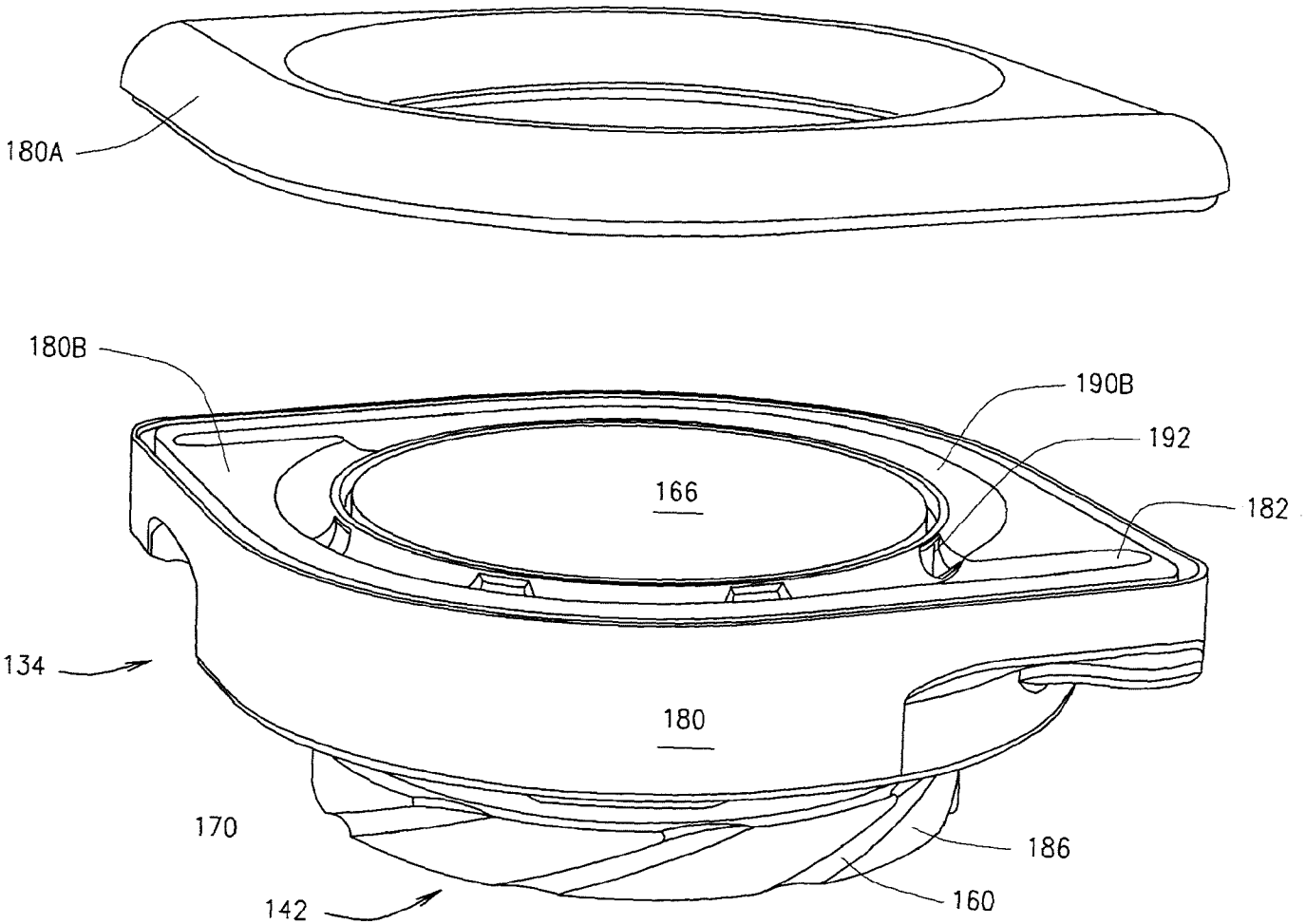
FIG. 12 is an exploded view of alternative fluid distributor insert.
Figure 13:
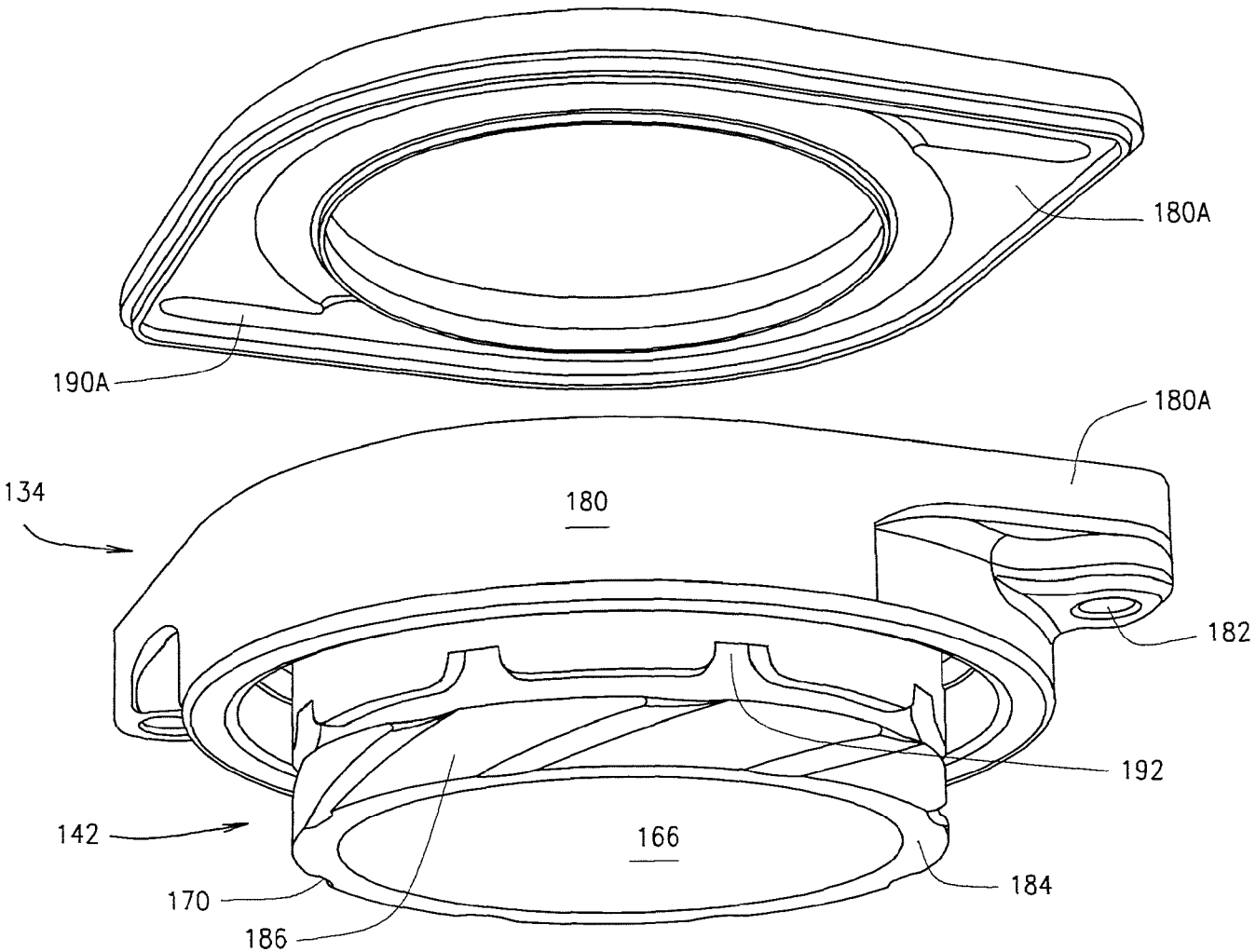
FIG. 13 is an exploded view of alternative fluid distributor insert.

FIG. 4 and FIG. 5 depict the internal structure of the spiral or swirl injection rinse liquid distributor 34. Insert 38 includes grooves 60. Insert 38 and receiver 36 are dimensioned such that when they are assembled together the grooves 60 are covered by the inner surface 40 of the receiver 36, and rinse channels are thereby defined between them. These rinse channels are in fluid communication with a liquid intake port 82. The fluid injection path is sealed by a recess 64 that serves as a seat for an O ring seal.

The grooves 60 and the rinse channels they form are oriented in a spiral configuration. Each rinse channel is at an angle therefore to the longitudinal axis of the cylinder 32. As will be appreciated by those of skill in the art, this spiral orientation advantageously avoids the streaking and consequent dry portions of the inner surface 46 of the chamber that was typical of prior art devices. That is, injection of the rinse liquid in a spiral fashion, at an angle to the axis of the tube, promotes 100% wetting. 100% wetting, in the shortest amount of time and/or with the smallest volume of rinse liquid, is further promoted by the titanium surface 46 of the cylindrical chamber 32.

As best seen in FIG. 5, the outer portion of the liquid distributor receiver 36 includes an annular seat 68 dimensioned to receive the cylindrical tube 32 comprising the collection chamber. The depth of the seat 68 is dimensioned to correspond to the thickness of the chamber wall 44. The liquid distributor insert 38 has an inner diameter 66 dimensioned to substantially match the inside diameter of the cylindrical chamber 32. Accordingly, upon assembly of the tube 32 with the outer liquid distributor receiver 36 and liquid distributor insert 38, an overall collection chamber assembly 30 having a constant internal diameter is created. At the juncture of the liquid distributor insert 38 and the tube 32 the inner walls of each mate and multiple exit ports 70 for the liquid rinse channels 60 are defined. Rinse liquid exit ports 70 are flush with the constant internal diameter of the overall assembly. Accordingly, the rinse liquid injector assembly advantageously avoids any structure obstructing air flow from the liquid distributor air intake 72 and through the chamber. Therefore the flow of air over the rinse liquid exiting the multiple exit ports 70 further promotes the rapid and complete disbursal of rinse liquid over substantially 100% of the inner surface 46 of the chamber wall.

FIGS. 9, 10, 11, 12 and 13 depict an alternative embodiment of the present invention. This alternate embodiment also avoids obstruction of air throughput by components of the liquid distributor, and also uses the air flow over the exit ports to spread, flatten and rapidly distribute the rinsing liquid over the interior wall of the chamber. The alternative embodiment is comprised of a chamber wall 132, which is again a cylinder in the depicted embodiment. The wall 132 defines within itself a collection chamber having a first diameter. The liquid distributor 134 is assembled to be a single piece in this embodiment. It has an interior wall 166 that defines a second diameter that is smaller than the first diameter defined by the chamber wall 132. The liquid distributor 134 has an annular extension 142 with an exterior wall 186 that has a diameter substantially corresponding to the interior diameter of the collection chamber wall 132, so that the later receives the former in close cooperation upon assembly to establish a tight fit. The liquid distributor 134 is further comprised of a housing 180 having at least one liquid intake port(s) 182 that is in fluid communication with the spiral liquid distribution rinse channels 160 and ultimately with the liquid exit ports 170. The rinse liquid channel is created in the housing 180 by assembling an upper housing portion 180A with a lower housing portion 180B, each of which has a trough, 190A and 190B respectively, that mate upon assembly and form the rinse channel 190 connecting intake port(s) 182 with spiral rinse channels 160. Interior rinse channel 190 proceeds through multiple vertical channels 192.

Upon assembly, the liquid exit ports 170 are disposed so that an outer side of the exit port 170 is substantially flush with the first diameter that is the inner wall of the collection chamber. The aperture of the exit ports 170 are on the step 184 that is the inner end of the liquid distribution extension 142.

Figure 14:
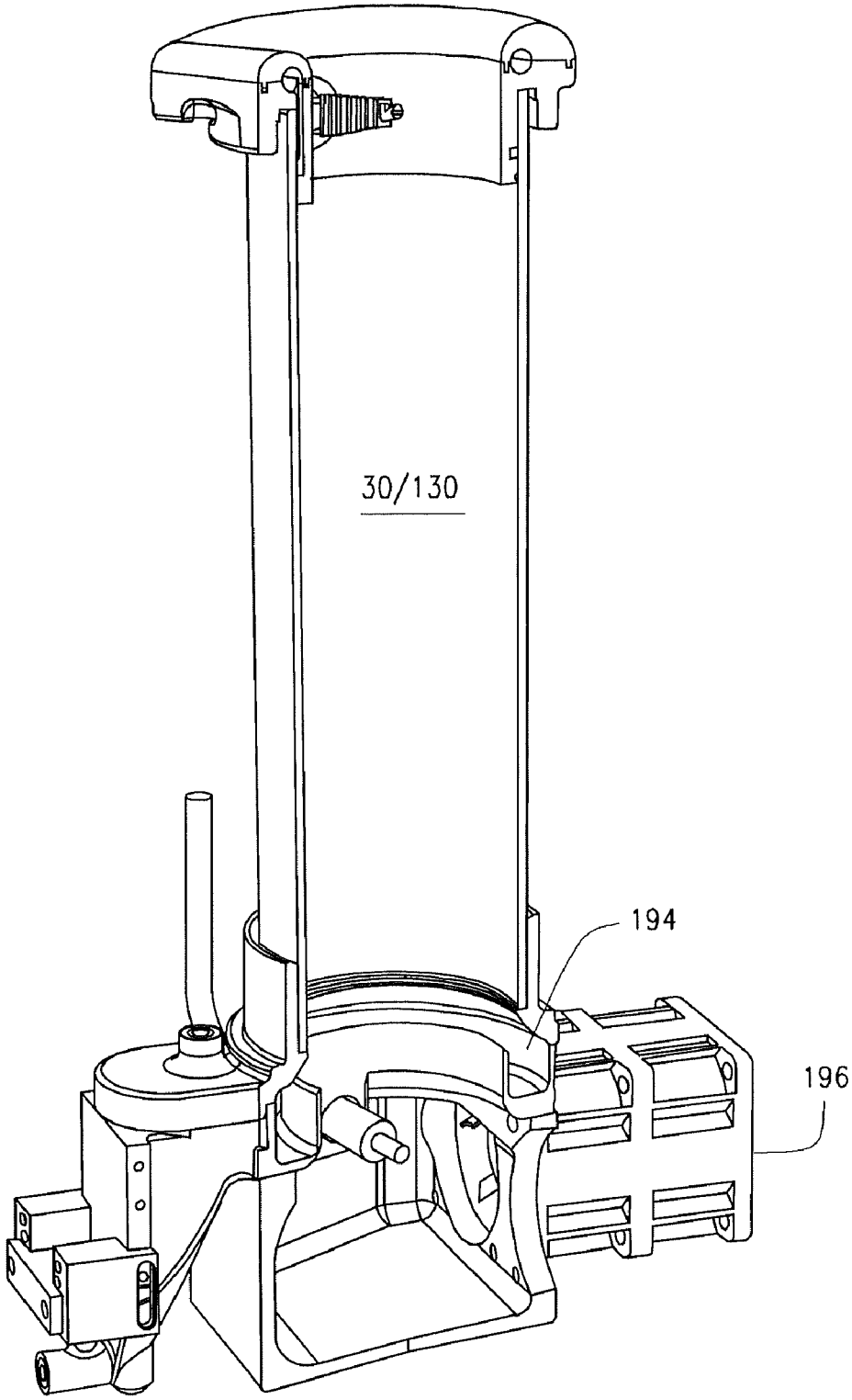
FIG. 14 is a cutaway view of the collection chamber and blower.

FIG. 14 is a cutaway view of the collector assembly showing the rinse liquid collection reservoir 194 and a blower 196.

In one embodiment, the particulate collector may be a cylinder having an internal diameter of between about 0.25 inches and about 6.0 inches. The particulate collector may have a length of between about 1.0 inches and about 36 inches. In embodiments with Titanium coatings, the coatings may be from about 0.25 microns to about 6 microns thick. In the depicted embodiments, the cylinder has a diameter of about 2 inches. The rinse liquid ports in the depicted embodiment are spaced about ¾ of an inch apart and the ports have a complex cross section ranging from about 1/64 of an inch to about ¼ of an inch.

Test data confirm an unexpected, synergistic effect when combining both a swirl liquid distributor with a titanium collection chamber wall in the configuration disclosed herein, as compared to the effect of either component by itself. The time and liquid volume needed to attain substantially 100% wetting is only marginally increased by combining a swirl liquid distributor as depicted herein with a traditional steel or aluminum inner chamber surface, in a compact contaminant sampling device. At a flow rate of 528 mil/min, 100% wetting was obtained in a range of from 9 to 34 seconds, with an average of about 19 seconds. Little or no improvement is achieved by combining a titanium inner chamber surface with a prior art weir liquid distributor, as compared to a traditional aluminum inner chamber surface combined with a weir liquid distributor, in a compact contaminant sampling device. In fact, 100% wetting was not achieved in experimental apparatuses combining a Titanium coated cylinder with a weir distributor.

Surprisingly, combining the swirl liquid distributors depicted herein with a titanium inner chamber surface in a compact contaminant sampling device improves results more than the sum of the individual degrees of improvement attained by each component individually. In a compact sample collector having both a swirl injector and titanium inner surface, substantially 100% wetting was attained faster and with less liquid than the expected sum of the two features tested individually. Hence, test data confirms an unexpected synergy when combining both features.

The particulate collector of this invention may attain substantially 100% wetting of said inner surface of said chamber with a rinse liquid flow rate of no more than about 520 milliliters/minute. The particulate collector may attain substantially 100% wetting of said inner surface of said chamber within no more than about 26 seconds. The particulate collector having a collection chamber of titanium coated aluminum may attain substantially 100% wetting of said inner surface of said chamber within no more than about 11 seconds at a rinse liquid flow rate of about 290 milliliters/minute.

EXAMPLES

In each of the examples, De-ionized (DI) water was used as the rinse liquid. DI water was pumped from a reservoir into the Fluid Distributor. Depending on the flow rate required, one or two diaphragm pumps were used to deliver the DI water to the Fluid Distributor. The DI water was collected in a beaker placed under the test item.

Using the test set-up described above, the flow rate required to produce a fully wetted collection surface within approximately 30 seconds was determined for each device configuration. The actual flow rate was calculated by measuring the amount of fluid collected in the beaker per unit time.

Using these fluid pump settings, a repetitive series of tests was performed to determine the required time to fully wet the collection surface. The collection surface was air dried between every test using a small fan.

Example 1

Prior Art

Aluminum Chamber Surface with Weir Distributor

| Configuration ID: 01<br>Collection Surface Treatment: Bead blasted Al 6061<br>Fluid Distributor: Weir<br>Serial Number: 01 | | |
|---|---|---|
| Test number | Flow Rate (ml/min) | Time to coat 100% (sec) |
| 1 | 1750 | 9 |
| 2 | 1750 | 25 |
| 3 | 1750 | 13 |
| 4 | 1750 | 33 |
| 5 | 1750 | 34 |
| 6 | 1750 | 26 |
| 7 | 1750 | 59 |
| 8 | 1750 | 18 |
| 9 | 1750 | 20 |

-continued

| Configuration ID: 01<br>Collection Surface Treatment: Bead blasted Al 6061<br>Fluid Distributor: Weir<br>Serial Number: 01 | | |
|---|---|---|
| Test number | Flow Rate (ml/min) | Time to coat 100% (sec) |
| 10 | 1750 | 5 |
| 11 | 1750 | 6 |
| 12 | 1750 | 13 |
| 13 | 1750 | 7 |
| 14 | 1750 | 4 |
| 15 | 1750 | 30 |
| 16 | 1750 | 4 |
| 17 | 1750 | 4 |
| 18 | 1750 | 35 |
| 19 | 1750 | 11 |
| 20 | 1750 | 6 |
| 21 | 1750 | 4 |
| 22 | 1750 | 4 |
| 23 | 1750 | 5 |
| 24 | 1750 | 6 |
| 25 | 1750 | 5 |
| 26 | 1750 | 5 |
| 27 | 1750 | 4 |
| 28 | 1750 | 6 |
| 29 | 1750 | 6 |
| 30 | 1750 | 11 |

Example 2A and 2B

Swirl Injector with Titanium Coated Aluminum Chamber

| Test number | Flow Rate (ml/min) | Time to coat 100% (sec) |
|---|---|---|
| Configuration ID: 02A<br>Collection Surface Treatment: Al with Ti coating<br>Fluid Distributor: Swirl injector | | |
| 1 | 285 | 4 |
| 2 | 285 | 4 |
| 3 | 285 | 10 |
| 4 | 285 | 6 |
| 5 | 285 | 4 |
| 6 | 285 | 5 |
| 7 | 285 | 11 |
| 8 | 285 | 5 |
| 9 | 285 | 4 |
| 10 | 285 | 5 |
| Configuration ID: 02B<br>Collection Surface Treatment: Al with Ti coating<br>Fluid Distributor: Swirl injector | | |
| 1 | 290 | 3 |
| 2 | 290 | 3 |
| 3 | 290 | 3 |
| 4 | 290 | 3 |
| 5 | 290 | 3 |
| 6 | 290 | 3 |
| 7 | 290 | 3 |
| 8 | 290 | 3 |
| 9 | 290 | 3 |
| 10 | 290 | 3 |

Example 3

Swirl Distributor with Polished Titanium Chamber

| Configuration ID: 03<br>Collection Surface Treatment: Polished Ti tube<br>Fluid Distributor: Swirl injector | | |
|---|---|---|
| Test number | Flow Rate (ml/min) | Time to coat 100% (sec) |
| 1 | 520 | 21 |
| 2 | 520 | 26 |
| 3 | 520 | 19 |
| 4 | 520 | 19 |
| 5 | 520 | 17 |
| 6 | 520 | 23 |
| 7 | 520 | 19 |
| 8 | 520 | 19 |
| 9 | 520 | 16 |
| 10 | 520 | 19 |

Example 4

Swirl Distributor with Titanium Coated Steel

| Configuration ID: 04<br>Collection Surface Treatment: SST with Ti coating<br>Fluid Distributor: Swirl injector | | |
|---|---|---|
| Test number | Flow Rate (ml/min) | Time to coat 100% (sec) |
| 1 | 365 | 14 |
| 2 | 365 | 32 |
| 3 | 365 | 23 |
| 4 | 365 | 29 |
| 5 | 365 | 24 |
| 6 | 365 | 21 |
| 7 | 365 | 17 |
| 8 | 365 | 21 |
| 9 | 365 | 21 |
| 10 | 365 | 22 |
| 11 | 365 | 27 |
| 12 | 365 | 30 |
| 13 | 365 | 35 |
| 14 | 365 | 35 |
| 15 | 365 | 14 |
| 16 | 365 | 31 |
| 17 | 365 | 30 |
| 18 | 365 | 21 |
| 19 | 365 | 31 |
| 20 | 365 | 23 |
| 21 | 365 | 29 |
| 22 | 365 | 31 |
| 23 | 365 | 21 |
| 24 | 365 | 49 |
| 25 | 365 | 28 |
| 26 | 365 | 30 |
| 27 | 365 | 23 |
| 28 | 365 | 35 |
| 29 | 365 | 36 |
| 30 | 365 | 27 |

Example 5

Swirl Distributor with Aluminum Chamber

| Configuration ID: 05<br>Collection Surface Treatment: Bead blasted Al 6061<br>Fluid Distributor: Swirl Injector<br>Serial Number: 01 | | |
|---|---|---|
| Test number | Flow Rate (ml/min) | Time to coat 100% (sec) |
| 1 | 528 | 11 |
| 2 | 528 | 22 |
| 3 | 528 | 23 |
| 4 | 528 | 17 |
| 5 | 528 | 11 |
| 6 | 528 | 28 |
| 7 | 528 | 32 |
| 8 | 528 | 22 |
| 9 | 528 | 26 |
| 10 | 528 | 22 |
| 11 | 528 | 20 |
| 12 | 528 | 27 |
| 13 | 528 | 34 |
| 14 | 528 | 15 |
| 15 | 528 | 13 |
| 16 | 528 | 16 |
| 17 | 528 | 23 |
| 18 | 528 | 21 |
| 19 | 528 | 25 |
| 20 | 528 | 17 |
| 21 | 528 | 28 |
| 22 | 528 | 11 |
| 23 | 528 | 16 |
| 24 | 528 | 16 |
| 25 | 528 | 11 |
| 26 | 528 | 15 |
| 27 | 528 | 16 |
| 28 | 528 | 9 |
| 29 | 528 | 11 |
| 30 | 528 | 12 |

Figure 15:
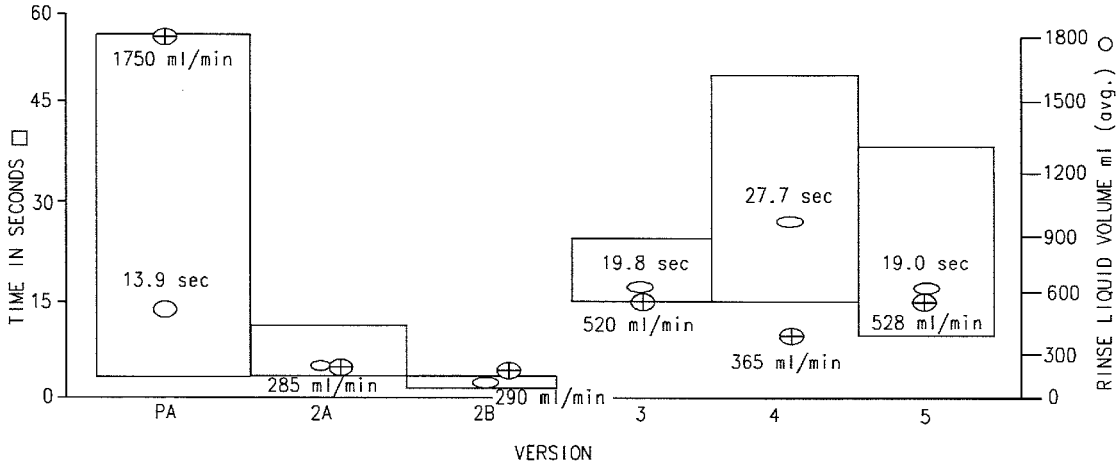
FIG. 15 is a graph of wetting times and rinse liquid volumes.

In FIG. 15, the y-axis left hand scale illustrates the time needed to achieve 100% wetting for each of the different versions from the examples, which are along the x-axis. The vertical bar extends from the fastest time to the slowest time for individual test runs, and a numerical average for each example version is given within the vertical bar at the oval. As can be seen, the lowest times achieved with any reliable consistency are with Example 2, a swirl distributor combined with titanium coated aluminum.

FIG. 15 also depicts the rinse liquid volume required to achieve 100% wetting with each of the different versions with the right hand scale of the y-axis. An oval with an X marks rinse liquid volumes. As can be seen, the prior art device having a Weir distributor and no titanium surface requires the most liquid by far, a disadvantage. All of the titanium coated examples have been proven to require a smaller volume of rinse liquid to achieve 100% wetting.

FIG. 15 combines the data for time results and rinse liquid volume results to illustrate the performance of all versions combining swirl injection with titanium chamber walls. As can be seen, Example 2, the combination of the swirl injector with titanium coated aluminum, surprisingly achieves advantageous results in both reduced time and reduced liquid volume required for 100% wetting, as compared to the other examples.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

The invention claimed is:

1. An electrostatic particulate collector comprising:

a chamber defined by an inner surface of a wall, said inner surface being titanium;

a potential inducer disposed within said chamber to create a field potential between said inducer and said wall;

a rinse channel, said rinse channel being angled to direct a rinse liquid in a spiral direction around said inner surface of said wall so as to wet said inner surface of said chamber;

whereby contaminants in air being sampled are electro statically biased into said rinse liquid on said wall and rinsed out of said chamber for collection;

said rinse channel being within a liquid distributor, said liquid distributor being assembled with one end of said chamber; and said liquid distributor being comprised of an insert component and a receiver component, said insert component and said receiver component, when assembled, defining said rinse channel therebetween.

2. The particulate collector of claim 1 further comprising:

a blower being disposed to propel air to be sampled through said chamber in a direction substantially parallel to an axis of said chamber, said chamber being cylindrical.

3. The particulate collector of claim 1 further comprising:

said particulate collector being configured in a portable housing.

4. The particulate collector of claim 1 further comprising:

said liquid distributor having an air flow through-hole with an internal diameter substantially the same as an internal diameter of said chamber.

5. The particulate collector of claim 1 further comprising:

said liquid distributor having an air flow through-hole with an internal diameter less than an internal diameter of said chamber.

6. The particulate collector of claim 1 further comprising:

said liquid distributor disposing an exit port of said rinse channel flush with an inner surface of said chamber.

7. The particulate collector of claim 1 further comprising:

said liquid distributor disposing an exit port of said rinse channel such that air flow through said chamber biases said rinse liquid to wet said inner surface of said chamber.

8. The particulate collector of claim 1 further comprising:

said wall being at least one of titanium, aluminum with a titanium coating on said inner surface, or steel with a titanium coating on said inner surface.

9. The particulate collector of claim 1 further comprising:

said chamber being a cylinder having an internal diameter of between about 0.25 inches and about 6.0 inches and a cylinder having a length of between about 1 inch and about 36 inches.

10. The particulate collector of claim 1 further comprising:

said inner surface of said chamber being substantially 100% wetted with a rinse liquid flow rate of no more than about 520 milliliters/minute.

11. The particulate collector of claim 1 further comprising:

said inner surface of said chamber being substantially 100% wetted within no more than about 36 seconds.

12. The particulate collector of claim 1 further comprising:

said inner surface of said chamber being substantially 100% wetted within no more than about 11 seconds at a rinse liquid flow rate of no more than about 290 milliliters/minute.

13. The particulate collector of claim 1 further comprising:

a second chamber having a second wall with an interior surface of titanium;

a second potential inducer;

a second rinse liquid distributor having spiral rinse channels being angled to direct a rinse liquid in a spiral direction around said inner surface of said second wall so as to wet said inner surface of said second chamber;

whereby contaminants in air being sampled are electro statically biased into said rinse liquid on said second wall and rinsed out of said second chamber for collection.

14. The particulate collector of claim 1 further wherein said rinse channels wet said inner surface of said chamber substantially 100%.

15. An electrostatic particulate collector comprising:

a chamber defined by an inner surface of a wall, said inner surface being titanium;

a potential inducer disposed within said chamber to create a field potential between said inducer and said wall;

a rinse channel, said rinse channel being angled to direct a rinse liquid in a spiral direction around said inner surface of said wall so as to wet said inner surface of said chamber;

whereby contaminants in air being sampled are electro statically biased into said rinse liquid on said wall and rinsed out of said chamber for collection;

said rinse channel being within a liquid distributor, said liquid distributor being assembled with one end of said chamber; and said liquid distributor being comprised of an insert component and a receiver component, said insert component and said receiver component, when assembled, disposing said rinse channels to wet an inner surface of said chamber.

16. The particulate collector of claim 15 further comprising:

a blower being disposed to propel air to be sampled through said chamber in a direction substantially parallel to an axis of said chamber, said chamber being cylindrical.

17. The particulate collector of claim 15 further comprising:

said particulate collector being configured in a portable housing.

18. The particulate collector of claim 15 further comprising:

said liquid distributor having an air flow through-hole with an internal diameter substantially the same as an internal diameter of said chamber.

19. The particulate collector of claim 15 further comprising:

said liquid distributor having an air flow through-hole with an internal diameter less than an internal diameter of said chamber.

20. The particulate collector of claim 15 further comprising:

said liquid distributor disposing an exit port of said rinse channel flush with an inner surface of said chamber.

21. The particulate collector of claim 15 further comprising:

said liquid distributor disposing an exit port of said rinse channel such that air flow through said chamber biases said rinse liquid to wet said inner surface of said chamber.

22. The particulate collector of claim 15 further comprising:

said wall being at least one of titanium, aluminum with a titanium coating on said inner surface, or steel with a titanium coating on said inner surface.

23. The particulate collector of claim 15 further comprising:

said chamber being a cylinder having an internal diameter of between about 0.25 inches and about 6.0 inches and a cylinder having a length of between about 1 inch and about 36 inches.

24. The particulate collector of claim 15 further comprising:

said inner surface of said chamber being substantially 100% wetted with a rinse liquid flow rate of no more than about 520 milliliters/minute.

25. The particulate collector of claim 15 further comprising:

said inner surface of said chamber being substantially 100% wetted within no more than about 36 seconds.

26. The particulate collector of claim 15 further comprising:

said inner surface of said chamber being, substantially 100% wetted within no more than about 11 seconds at a rinse liquid flow rate of no more than about 290 milliliters/minute.

27. The particulate collector of claim 15 further comprising:

a second chamber having a second wall with an interior surface of titanium;

a second potential inducer;

a second rinse liquid distributor having spiral rinse channels being angled to direct a rinse liquid in a spiral direction around said inner surface of said second wall so as to wet said inner surface of said second chamber;

whereby contaminants in air being sampled are electro statically biased into said rinse liquid on said second wall and rinsed out of said second chamber for collection.

28. The particulate collector of claim 15 further wherein said rinse channels wet said inner surface of said chamber substantially 100%.

29. An electrostatic particulate collector comprising:

a chamber defined by an inner surface of a wall, said inner surface being titanium;

a potential inducer disposed within said chamber to create a field potential between said inducer and said wall;

a rinse channel, said rinse channel being angled to direct a rinse liquid in a spiral direction around said inner surface of said wall so as to wet said inner surface of said chamber;

whereby contaminants in air being sampled are electro statically biased into said rinse liquid on said wall and rinsed out of said chamber for collection;

said rinse channel being within a liquid distributor, said liquid distributor being assembled with one end of said chamber; and said liquid distributor being comprised of an insert component and a receiver component, said insert component having a frustoconical outer surface, and said receiver component having a frustoconical inner surface;

said outer surface of said insert component and said inner surface of said receiver component being dimensioned to mate in close cooperation when said components are assembled.

30. The particulate collector of claim 29 further comprising:

a blower being disposed to propel air to be sampled through said chamber in a direction substantially parallel to an axis of said chamber, said chamber being cylindrical.

31. The particulate collector of claim 29 further comprising:

said particulate collector being configured in a portable housing.

32. The particulate collector of claim 29 further comprising:

said liquid distributor having an air flow through-hole with an internal diameter substantially the same as an internal diameter of said chamber.

33. The particulate collector of claim 29 further comprising:

said liquid distributor having an air flow through-hole with an internal diameter less than an internal diameter of said chamber.

34. The particulate collector of claim 29 further comprising:

said liquid distributor disposing an exit port of said rinse channel flush with an inner surface of said chamber.

35. The particulate collector of claim 29 further comprising:

said liquid distributor disposing an exit port of said rinse channel such that air flow through said chamber biases said rinse liquid to wet said inner surface of said chamber.

36. The particulate collector of claim 29 further comprising:

said wall being at least one of titanium, aluminum with a titanium coating on said inner surface, or steel with a titanium coating on said inner surface.

37. The particulate collector of claim 29 further comprising:

said chamber being a cylinder having an internal diameter of between about 0.25 inches and about 6.0 inches and a cylinder having a length of between about 1 inch and about 36 inches.

38. The particulate collector of claim 29 further comprising:

said inner surface of said chamber being substantially 100% wetted with a rinse liquid flow rate of no more than about 520 milliliters/minute.

39. The particulate collector of claim 29 further comprising:

said inner surface of said chamber being substantially 100% wetted within no more than about 36 seconds.

40. The particulate collector of claim 29 further comprising:

said inner surface of said chamber being substantially 100% wetted within no more than about 11 seconds at a rinse liquid flow rate of no more than about 290 milliliters/minute.

41. The particulate collector of claim 29 further comprising:

a second chamber having a second wall with an interior surface of titanium;

a second potential inducer;

a second rinse liquid distributor having spiral rinse channels being angled to direct a rinse liquid in a spiral direction around said inner surface of said second wall so as to wet said inner surface of said second chamber;

whereby contaminants in air being sampled are electro statically biased into said rinse liquid on said second wall and rinsed out of said second chamber for collection.

42. The particulate collector of claim 29 further wherein said rinse channels wet said inner surface of said chamber substantially 100%.

* * * * *